US006263654B1

(12) United States Patent
Stahlecker

(10) Patent No.: US 6,263,654 B1
(45) Date of Patent: Jul. 24, 2001

(54) ARRANGEMENT FOR A RING SPINNING MACHINE FOR CONDENSING A FIBER STRAND AND METHOD OF MAKING SAME

(75) Inventor: Hans Stahlecker, Haldenstrasse 20, 73079 Suessen (DE)

(73) Assignees: Fritz Stahlecker, Bad Uberkingen; Hans Stahlecker, Sussen, both of (DE)

( * ) Notice: Subject to any disclaimer, the term of this patent is extended or adjusted under 35 U.S.C. 154(b) by 0 days.

(21) Appl. No.: 09/361,527

(22) Filed: Jul. 27, 1999

(30) Foreign Application Priority Data

Aug. 10, 1998 (DE) ..... 198 36 135

(51) Int. Cl.[7] ..... D01H 13/04; D01H 5/86

(52) U.S. Cl. ..... 57/315; 19/246

(58) Field of Search ..... 57/315, 304; 19/236, 19/237, 238, 239, 240, 241, 242, 243, 244, 245, 246, 247, 250, 252, 286, 287, 288, 150, 304, 305, 306, 307, 308; 198/846, 689.1; 139/425 A

(56) References Cited

U.S. PATENT DOCUMENTS 3,122,794 * 3/1964 Klein ..... 19/288
3,772,739 * 11/1973 Lovgren ..... 19/302 X
3,915,202 * 10/1975 Curtis et al. ..... 139/425 A
4,475,272 * 10/1984 Wood ..... 19/150 X
4,489,540 * 12/1984 Faure et al. ..... 57/5
4,891,040 * 1/1990 Nagai et al. ..... 139/383 R
4,953,349 * 9/1990 Fehrer ..... 57/315
5,085,046 * 2/1992 Fehrer ..... 57/315
5,285,624 * 2/1994 Stahlecker ..... 57/328
5,313,689 * 5/1994 Oexler ..... 198/689.1
5,699,707 * 12/1997 Campbell, Jr. ..... 198/689.01
5,890,356 * 4/1999 Stahlecker ..... 57/401
6,073,314 * 6/2000 Barauke ..... 19/288 X
6,082,089 * 7/2000 Stahlecker ..... 57/315
6,108,873 * 8/2000 Barauke ..... 19/236

FOREIGN PATENT DOCUMENTS 197 11 466A1 10/1997 (DE) .

* cited by examiner

*Primary Examiner*—Rodney Lindsey
(74) *Attorney, Agent, or Firm*—Crowell & Moring, L.L.P.

(57) ABSTRACT

An arrangement for a ring spinning machine for condensing a drafted but untwisted fiber strand includes a drum which transports the fiber strand through a condensing zone. The drum is provided on its outer sleeve with a perforation. In order that the perforation can be particularly fine and close-meshed, the outer sleeve of the drum forms a supporting skeleton, which comprises openings, which are covered over by a thin sieve belt, preferably a woven tape. The sieve belt extends over a suction slit located in the condensing zone. The skeleton is so formed that in the area of nipping points, formed together with the drum, the skeleton is sufficiently resistant.

17 Claims, 2 Drawing Sheets

ARRANGEMENT FOR A RING SPINNING MACHINE FOR CONDENSING A FIBER STRAND AND METHOD OF MAKING SAME

BACKGROUND AND SUMMARY OF THE INVENTION

This application claims the priority of German application 198 36 135.1, filed in Germany on Aug. 10, 1998, the disclosure of which is expressly incorporated by reference herein.

The present invention relates to an arrangement for a ring spinning machine for condensing a drafted but untwisted fiber strand, comprising a drum, having a perforated outer sleeve, for transporting the fiber strand through a condensing zone, which is limited at its exit side by a nipping point which nips the fiber strand, also comprising a suction device arranged in the inside of the drum, which suction device comprises a suction slit extending essentially in transport direction of the fiber strand.

In an arrangement of this type (German published patent application 197 11 466), the perforated drum is at the same time the front roller of a drafting assembly. The condensing zone is located thus on the periphery of the drum and is defined by two nipping points formed together with the drum. The first nipping point is located on the front top roller of the drafting assembly, the second nipping point at an extra nipping roller, which functions at the same time as a twist block against the spinning twist imparted by a ring spindle, so that the condensing zone is free of spinning twist. The outer sleeve of the drum must permit the draft at the front roller pair of the drafting assembly. The outer sleeve is therefore quite thick-walled, which inevitably means that the holes of the perforation cannot exceed a minimum diameter. This results in the condensing zone being subjected to a relatively inhomogenous suction air stream, which is disadvantageous for the condensing effect.

The condensing of the drafted, but still spinning twist-free fiber strand serves the purpose of bundling the fiber strand before it is imparted a spinning twist, in that outwardly projecting edge fibers are rolled in around the core strand. The fiber strand becomes less hairy, the usual spinning triangle is reduced to a great extent and the spun yarn becomes with better substance utilization more homogenous, smoother and tear resistant overall.

It is an object of the present invention to make the suction air stream, effective in the condensing zone, more homogenous and thus to increase the condensing effect.

This object has been achieved in accordance with the present invention in that the outer sleeve forms a supporting skeleton for a thin sieve belt, which covers openings present in the outer sleeve in the area of the suction slit.

Deviating from prior art, the outer sleeve is no longer provided with a plurality of bore holes having a relatively large diameter, but is rather in the form of a skeleton, which comprises large, ladder-like openings over the suction slit. These openings are covered by a thin, close-meshed sieve belt, which is applied to the outer sleeve, so that a very fine and close-meshed perforation for the suction air stream arises, which makes the suction air stream very homogenous. It has been shown, namely, that the more close-meshed the perforation, the better the quality of the spun yarn. As the thin sieve belt is not capable of taking up the necessary nipping pressure at the nipping points itself, the openings of the skeleton must be sufficiently narrow. The openings are therefore advantageously narrow cross slits which are covered by the close-meshed sieve belt. The sieve belt thus cannot yield to the nipping pressures in the area of the openings.

If desired the sieve belt can also be drawn onto a ladder-like skeleton belt, which in turn is adhered or welded to the outer sleeve of the drum. This is then in particular possible when a suitable synthetic fiber is chosen.

The sieve belt is preferably in the form of a woven fabric made of polyamide filaments, so that the sieve belt can also be stiffened at its edges by means of heating. In this embodiment of the present invention, the sieve belt is sufficiently wear resistant.

When the woven belt is provided with a suitable sealable coating on its longitudinal edges, the sieve belt can be applied to the outer sleeve of the drum in an exchangeable way. The adhering effect by means of sealing should only be so strong as to permit the sieve belt to be easily removed without great use of force.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
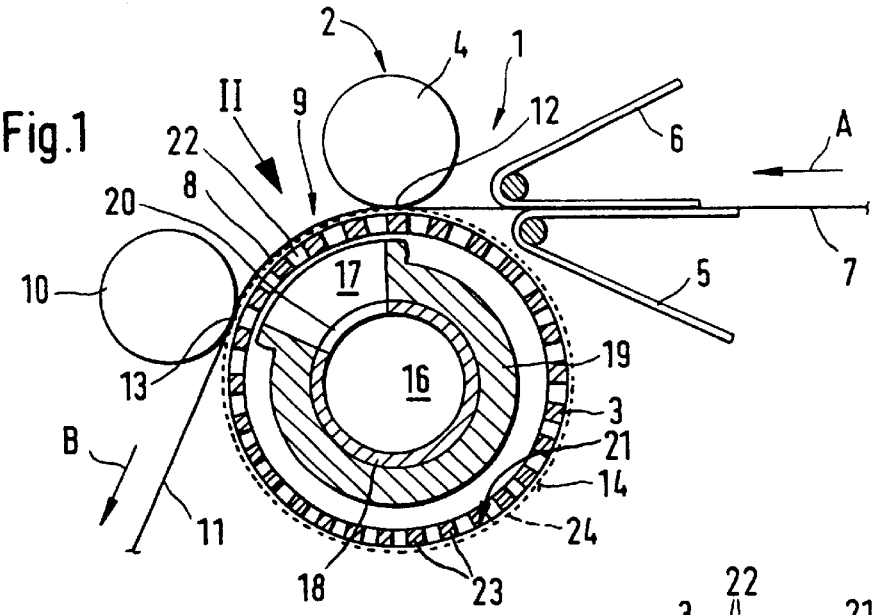
FIG. 1 is a part sectional side view through a perforated drum according to the present invention.

The arrangement for condensing in a ring spinning machine according to the present invention acts together with a drafting assembly 1, of which, apart from the front roller pair 2, only an apron pair are shown, which comprises a bottom apron 5 and a top apron 6 The driven bottom roller of the front roller pair 2 is designed as a perforated drum 3 having a relatively large diameter, the upper roller of the front roller pair 2 is, in a known way, a top roller 4, which forms a nipping point 12 together with the drum 3. In the drafting assembly 1, in a known way, a fiber strand or roving 7 transported in transport direction A is drafted to the desired extent. At the front roller pair 2, a practically fully drafted, but yet still untwisted fiber strand 8 is present.

The above mentioned condensing zone 9, which is located on the periphery of the drum 3, is directly adjoining the nipping point 12, through which condensing zone 9 the fiber strand 8 is transported by the drum 3 to a further nipping point 13. This nipping point 13 is formed between the drum 3 and a nipping roller 10. From the nipping point 13, the condensed yarn 11 is fed in delivery direction B to a ring spindle (not shown), which imparts a spinning twist to the yarn 11. As regards the spinning twist, the nipping point 13 acts as a twist block.

The condensing zone 9 is defined on its entry side and its exit side by nipping points 12 and 13, so the condensing is effected on an almost fully drafted, apart from a slight tension draft, but untwisted fiber strand 8.

The outer sleeve 14 of the drum 3 is designed in such a stable way that it is able to withstand the nipping pressures at the nipping points 12 and 13. A suction air stream is suctioned by means of the perforation 15, which is described below in detail, through the outer sleeve 14, which suction air stream pulls the fiber strand 8 onto the outer sleeve 14.

Figure 2:
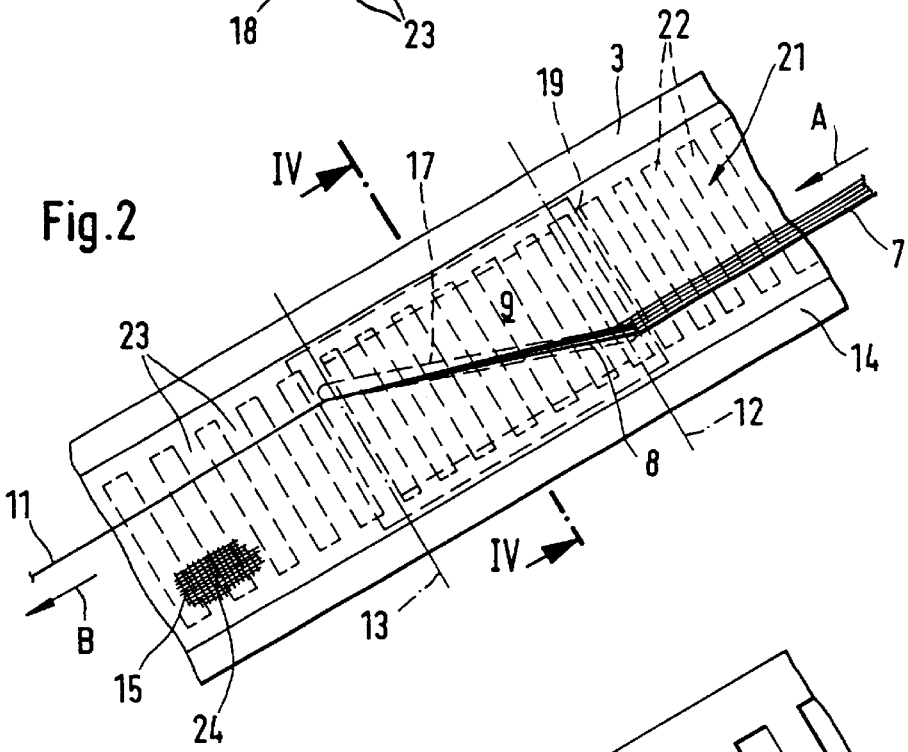
FIG. 2 is a view in the direction of the arrow 11 of FIG. 1 onto the developed outer sleeve of the drum.

The suction air stream is effected by a suction device 16 which is arranged in the inside of the drum 3, which suction device 16 is directed with a narrow suction slit 17 at the area of the condensing zone 9. The suction slit 17 is arranged at the perforation 15, said suction slit 17 extending practically exactly between the two nipping points 12 and 13. The suction slit 17 is, as can be seen in particular in FIG. 2, arranged slightly transversely to the transport direction A, so that the fiber strand 8 guided over the suction slit 17 is imparted a slight twist in the condensing zone 9, which increases the condensing effect. The width of the suction slit 17 is somewhat larger than the width of the condensed fiber strand 8.

The suction device 16 comprises a suction tube 18, on which the drum 3 is supported in a way not shown. A regulatable suction insert 19 is located on the suction tube 18, which suction insert 19 bridges over the gap between a suction opening 20 located in the suction tube 18 and the suction slit 17.

In order that the outer sleeve 14 of the drum 3 is sufficiently stable to withstand the nipping pressures, but still having a fine a perforation 15 as possible, the outer sleeve 14 is designed as a ladder-like skeleton 21. A plurality of openings 22 are present, which are in the form of cross slits, which have approximately the width of the condensing zone 9. The openings 22 are defined by metal cross pieces 23. The cross pieces 23 are so narrow that the openings 22 have overall as large a surface as possible, that is, the openings 22 should be on the one hand as large as possible, but on the other hand be themselves so narrow that the nipping pressures at the nipping points 12 and 13 can be taken up without fault. The openings 22 of the ladder-like skeleton 21 are covered over by a thin sieve belt 24, by means of which the actual close-meshed perforation 15 is formed. The sieve belt 24 is designed as a fabric tape of polyamide filaments and is somewhat wider than the openings 22 in traverse direction of the outer sleeve 14. A very homogenous air suction stream flows through the very close-meshed perforation 15, formed by the sieve belt 24, which suction air stream ensures a good condensing effect.

Figure 3:
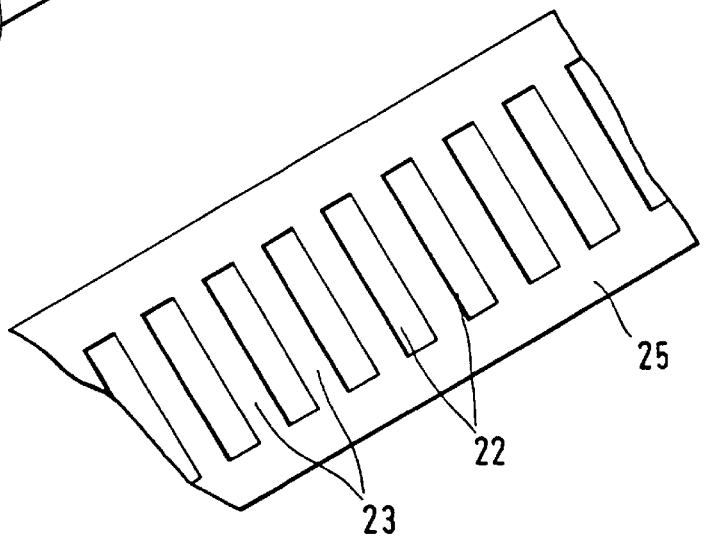
FIG. 3 is a similar view to FIG. 2, whereby for the application of a sieve belt a ladderlike skeleton belt is provided.
Figure 4:
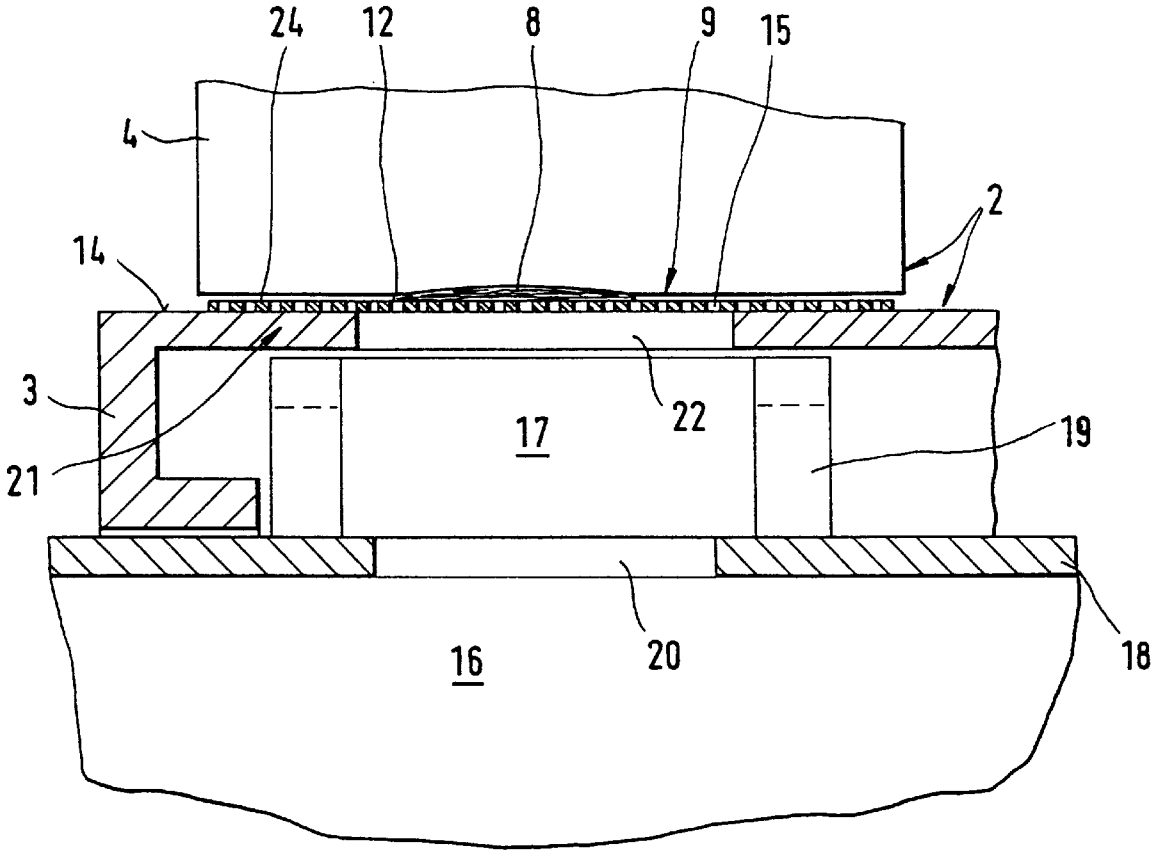
FIG. 4 is a greatly enlarged view taken along the sectional surface IV—IV of FIG. 2.

According to FIG. 3, the outer sleeve 14 can alternatively comprise a skeleton belt 25, which is adhered or welded to the perforated drum 3. The skeleton belt 25 in turn takes up the sieve belt 24.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A condensing drum assembly for a ring spinning machine, comprising:

a suction tube, a perforated outer sleeve surrounding the suction tube, said outer sleeve having radial through openings and being radially spaced from the suction tube to form an annular gap, said outer sleeve exhibiting sufficient structural rigidity to form a fiber strand nipping point together with a facing roller when in an in use position, and a thin sieve belt connected to said outer sleeve to cover said through openings of said outer sleeve while permitting passage of suction air through the thin sieve belt.

2. A condensing drum assembly according to claim 1, wherein the outer sleeve is formed as a cylindrical supporting skeleton roller with parallel spaced slot shaped openings extending in an axial direction of the outer sleeve.

3. A condensing drum assembly according to claim 1, wherein the sieve belt is designed as a woven fabric made of polyamide filaments.

4. A condensing drum assembly according to claim 2, wherein the sieve belt is designed as a woven fabric made of polyamide filaments.

5. A condensing drum assembly according to claim 1, wherein the outer sleeve comprises a belt which is secured to a drum.

6. A condensing drum assembly according to claim 2, wherein the outer sleeve comprises a belt which is secured to a drum.

7. A condensing drum assembly according to claim 3, wherein the outer sleeve comprises a belt which is secured to a drum.

8. A condensing drum assembly according to claim 1, wherein the si eve belt is applied in an exchangeable way.

9. A condensing drum assembly according to claim 2, wherein the sieve belt is applied in an exchangeable way.

10. A condensing drum assembly according to claim 4, wherein the sieve belt is applied in an exchangeable way.

11. A method of making a condensing drum assembly for a ring spinning machine, comprising:

providing a suction tube, surrounding the suction tube with a perforated outer sleeve, said outer sleeve having radial through openings and being radially spaced from the suction tube to form an annular gap, said outer sleeve exhibiting sufficient structural rigidity to form a fiber strand nipping point together with a facing roller when in an in use position, and connecting a thin sieve belt to said outer sleeve to cover said through openings of said outer sleeve while permitting passage of suction air through the thin sieve belt.

12. A method of making a condensing drum assembly for a ring spinning machine according to claim 11, wherein the radial thickness of the outer sleeve is substantially greater than the radial thickness of the sieve belt.

13. A method of making a condensing drum assembly for a ring spinning machine according to claim 11, wherein said through openings of the outer sleeve are bounded by metal cross pieces.

14. A method of making a condensing drum assembly for a ring spinning machine according to claim 13, wherein said thin sieve belt is made of a woven fabric.

15. A method of making a condensing drum assembly for a ring spinning machine according to claim 14, wherein said woven fabric is made of polyamide filaments.

16. A method of making a condensing drum assembly for a ring spinning machine according to claim 11, wherein the sieve belt is designed as a woven fabric made of polyamide filaments.

17. A method of making a condensing drum assembly for a ring spinning machine according to claim 11, wherein the sieve belt is applied in an exchangeable way.

* * * * *